US012262827B2

(12) United States Patent
Taylor

(10) Patent No.: US 12,262,827 B2
(45) Date of Patent: Apr. 1, 2025

(54) HANGER ARRANGEMENT

(71) Applicant: THE JANGER LIMITED, London (GB)

(72) Inventor: Guy Taylor, London (GB)

(73) Assignee: THE JANGER LIMITED, London (GB)

( * ) Notice: Subject to any disclaimer, the term of this patent is extended or adjusted under 35 U.S.C. 154(b) by 165 days.

(21) Appl. No.: 17/780,638

(22) PCT Filed: Nov. 23, 2020

(86) PCT No.: PCT/GB2020/052979
§ 371 (c)(1),
(2) Date: May 27, 2022

(87) PCT Pub. No.: WO2021/105655
PCT Pub. Date: Jun. 3, 2021

(65) Prior Publication Data

US 2023/0000271 A1 Jan. 5, 2023

(30) Foreign Application Priority Data

Nov. 29, 2019 (GB) ..... 1917456

(51) Int. Cl.
*A47G 25/30* (2006.01)
*A47G 25/34* (2006.01)

(52) U.S. Cl.
CPC ..... *A47G 25/30* (2013.01); *A47G 25/34* (2013.01)

(58) Field of Classification Search
CPC ..... A47G 25/743; A47G 25/30; A47G 25/34
See application file for complete search history.

(56) References Cited

U.S. PATENT DOCUMENTS 3,710,996 A * 1/1973 Smilow ..... A47G 25/743 223/87
5,222,638 A 6/1993 Kolton et al.
6,299,039 B1 10/2001 Hsu
D657,577 S * 4/2012 Coote ..... D6/328
8,651,344 B2 * 2/2014 Norman ..... A47G 25/1407 223/87

(Continued)

FOREIGN PATENT DOCUMENTS

AT 517615 B1 * 3/2017
GB 2474314 4/2011

(Continued)

OTHER PUBLICATIONS

International Search Report and Written Opinion of the corresponding PCT application dated Jun. 3, 2021.

*Primary Examiner* — F Griffin Hall
(74) *Attorney, Agent, or Firm* — Renner, Otto, Boisselle & Sklar, LLP

(57) ABSTRACT

A garment hanger (10) comprising a rail engaging portion (16) and garment supporting means in the form of a deformable elongate member (20). The end of the elongate member distal from the rail engaging portion comprises a first part (22) of a connection mechanism such that the elongate member (22) can be deformed back upon itself and connected to a second part (24) of the connection mechanism of the hanger to form a closed loop. The elongate member (20) comprises a side flange (32) along its length.

13 Claims, 3 Drawing Sheets

(56) References Cited

U.S. PATENT DOCUMENTS

| | | | | | |
|---|---|---|---|---|---|
| 8,994,535 | B2 * | 3/2015 | Coote | A47G 25/1442 | 340/568.1 |
| D767,289 | S * | 9/2016 | Taylor | D6/323 | |
| D774,317 | S * | 12/2016 | Taylor | D6/323 | |
| D793,747 | S * | 8/2017 | Taylor | D6/323 | |
| 9,820,589 | B2 * | 11/2017 | Coote | A47G 25/743 | |
| D811,755 | S * | 3/2018 | Taylor | D6/323 | |
| D843,120 | S * | 3/2019 | Taylor | D6/323 | |
| D860,659 | S * | 9/2019 | Taylor | D6/323 | |
| D946,289 | S * | 3/2022 | Taylor | D6/323 | |
| 11,700,961 | B2 * | 7/2023 | Taylor | A47G 25/28 | 223/85 |
| 2021/0337994 | A1 * | 11/2021 | Taylor | A47G 25/1428 | |

FOREIGN PATENT DOCUMENTS

| | | | |
|---|---|---|---|
| JP | 2010178836 | A | 8/2010 |
| WO | 2011/086376 | A1 | 7/2011 |
| WO | 2015/107341 | A2 | 7/2015 |

* cited by examiner

HANGER ARRANGEMENT

This application claims the benefit of GB 1917456.4 filed on Nov. 29, 2019; and PCT/GB2020/052979 filed on Nov. 23, 2020. Both of which are herein incorporated by reference in their entirety.

FIELD OF THE INVENTION

The invention relates to garment hangers, particularly garment hangers that comprise a releasably closable loop.

BACKGROUND TO THE INVENTION

Belt hangers and garment hangers with releasably closable loops have previously been proposed, for example, GB2474314 (Robert Coote). However, if the snap-fit connector is stiff, it can prove difficult to disconnect the connection mechanism in order to disengage the garment hanger from a garment. When it is difficult to disconnect the garment hanger from a garment, the customer may be less inclined to try on the garment and the re-hanging time for staff is increased. Additionally, a user may damage their fingernails if the connection mechanism is too stiff.

SUMMARY OF THE INVENTION

Accordingly, the present invention is directed to a garment hanger comprising a rail engaging portion and garment supporting means in the form of a deformable elongate member, the end of the elongate member distal from the rail engaging portion comprising a first part of a connection mechanism such that the elongate member can be deformed back upon itself and connected to a second part of the connection mechanism of the hanger to form a closed loop, wherein the elongate member comprises a side flange along its length.

The side flange comprises a section of material that extends away from the axial direction of the elongate member to provide a region of material against which a user can provide a force, preferably using a finger or thumb and the pad thereof, to more readily release the connection mechanism. The connection mechanism, which holds the elongate member in a closed loop, retains the respective parts of the connection mechanism in engagement, but they are readily releasable, preferably in a non-destructive manner, upon sufficient force being applied to separate the parts, which is made easier by use of the side flange. Thus, the side flange makes engaging and disengaging the respective parts of the connection mechanism easier by applying a force close to one of the parts of the connection mechanism.

It is preferable that the side flange is at or adjacent the end of the elongate member distal from the rail engaging portion. By positioning the side flange away from the rail engaging portion, a user can hold the rail engaging portion and use the side flange to provide a separating force to disengage the parts of the connection mechanism. Alternatively, the user may hold the side flange and push against the rail engaging portion or a body of the hanger, if present, to disengage the connection mechanism. It will be appreciated that the side flange should be positioned towards the end of the elongate member that is distal from the rail engaging portion. Thus, whilst it might not be at the free end of the elongate member, it should be adjacent thereto so that, in a closed position, pressure on the side flange moves the distal end of the elongate member away from the rail engaging portion and/or the body of the hanger.

Whilst it is preferred that the connection mechanism comprises a click-fit fastening, other mechanisms that require mechanical force to disengage may be employed. The click-fit fastening, which may be in the form of a nipple and hole, is a simple and readily mouldable arrangement.

It may be the case that the rail engaging portion is a hook with an opening therein. Where a hook is employed, it may be preferable to have the side flange arranged on the same side of the hanger as the opening of the hook. This makes the device easier to hold and operate, although it will be appreciated that the hook opening and the side flange can be arranged on opposing sides of the device.

In one arrangement, the side flange comprises a debossed or embossed section. This allows the side flange to be provided with instructions and/or a grip section to allow it to be more readily held and/or engaged by a user and to reduce the risk of a user's finger or thumb slipping off the side flange. The grip section may be present on one or both sides.

In one arrangement, the deformable elongate member comprises a least one aperture therein. This at least one aperture, which may be additional to any aperture that is required for the connection mechanism, can be used to attach the garment hanger to a garment independently from the elongate member. A flexible tie may be passed through the aperture and secured to the garment to fix the garment hanger thereto independently of threading the elongate member onto the garment.

It is advantageous that the side flange is less than half of the width of the elongate member and, more advantageously, the side flange is a third or a quarter of the width of the elongate member. The side flange is thus sufficiently sized to provide a position to provide force, without being too large to hinder or prevent the elongate member being threaded through a loop on a garment, for example a belt loop. Additionally, the leading edge and/or rear edge of the side flange may be tapered or chamfered to allow the elongate member to more readily slide through a loop on a garment.

Preferably, the side flange extends in a direction non-parallel with the length of the elongate member. The side flange may extend in a direction that is non-parallel with the axial length of the elongate member, and it may be directed perpendicular to the length of the elongate member. The edge of the side flange may be angled to allow it to pass more readily through an aperture in one or both directions. Where one of edges is angled, the other edge may be angled to a lesser degree to make it more difficult for the hanger to disengage a garment to which it is attached.

The side flange may be provided with an aperture therein. This allows objects, such as labels, flexible ties or tags, to be attached to the hanger using the distal end of the elongate member.

The invention extends to a method of hanging a garment comprising the steps of:

- providing a garment hanger according to any preceding claim;
- threading the elongate member through at least one loop of material on a garment; and
- closing the elongate member by connecting the respective parts of the connection mechanism of the garment hanger.

By engaging a loop of material on a garment, the garment hanger can be readily hung on a garment and, preferably, the garment hanger is threaded through a plurality of loops of material on the garment. This provides a reliable and secure engagement between the garment and the garment hanger.

It is advantageous that a tie is provided through a retaining aperture in the elongate member and the tie engages one loop of material on the garment to connect the garment hanger to the garment independently from the elongate member engaging at least one loop of material of the garment. The tie engages the garment independently from the garment hanger, thereby allowing the garment hanger to be retained on the garment when the garment hanger is disengaged.

The garment hanger of the present invention may comprise an element-receiving channel to slidably receive an information element. Employing a channel to slidably receive an element, for example a sizer, provides a convenient location to slide a sizer onto the hanger that avoids having to thread the element onto the hook of a hanger. Additionally, it can be located to avoid any interference with the internal edge of the support engaging portion, which is normally a hook. Furthermore, it can be readily accessed and easily applied and removed. In an advantageous arrangement, the information element is applied to the channel from a direction non-perpendicular to the length of the channel.

It is preferable that at least one end of the channel is arranged adjacent the edge of the hanger. Having the channel positioned adjacent the edge of the hanger allows the end of the channel to be substantially open at at least one end to allow the information element to be readily positioned and slid onto, and from, the garment hanger. The open end of the channel makes the application and removal easier, particularly if the axial length of the channel is adjacent an edge of the hanger.

In one arrangement, the channel comprises a lip at, or adjacent, one end. This reduces the risk of inadvertent disengagement of the element because the element can be positioned within the channel and the lip can abut an end of the element and provide some resistance to disengagement.

Advantageously, the channel is located on a hook portion or a body portion of the garment hanger, which provides an easily visible location for customers to see the information.

It is preferable that at least a portion of the hook and/or body portion of the hanger is substantially planar and the element-receiving channel is located on that planar portion. Where there is a planar or flat section, it is easier to apply and remove the element to/from the hanger. The whole hanger may comprise a planar material or just part of the hanger may be made of the planar material.

The invention extends to a garment hanger assembly comprising:

a garment hanger as described herein; and an information element;

wherein the information element slidably engages the element-receiving channel of the garment hanger and is retained therein.

The arrangement of a garment hanger and slidable information element engaging the garment hanger provides a readily replaceable information element that can be reliably retained on the hanger and quickly changed, when needed.

It is preferable that the information element comprises a substantially U-shaped recess that engages the garment hanger and, more preferably, the information element has protrusions or teeth that abut the walls of the element-receiving channel when engaged on the garment hanger. This allows the element to wrap around the hanger and to grip onto the hanger, within the element-receiving channel.

Advantageously, the garment hanger and the information element are made from polypropylene. Employing the same material for both parts allows the combination to be readily recycled without having to disengage the parts beforehand.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
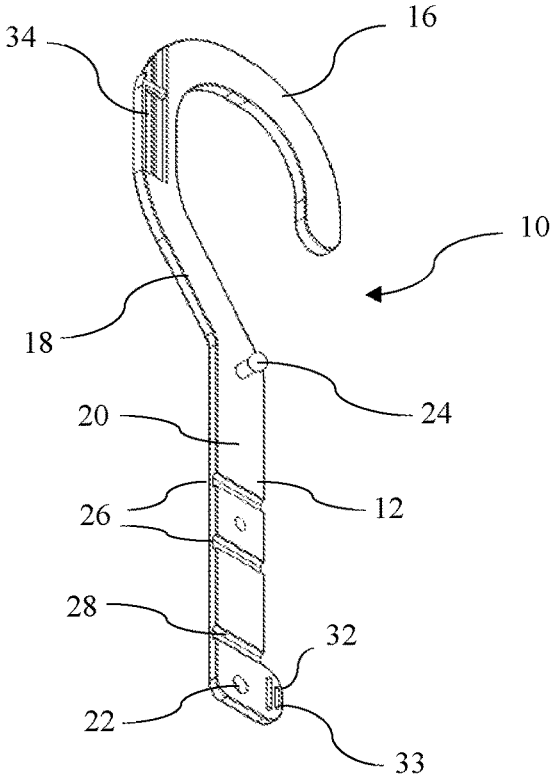
FIG. 1 shows a garment hanger in accordance with the present invention.
Figure 2:
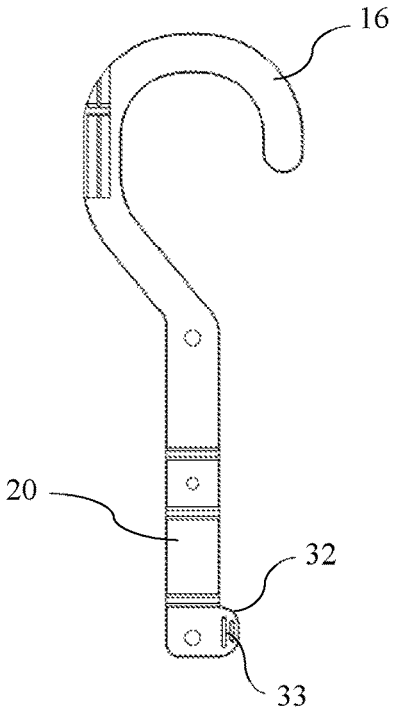
FIG. 2 shows a front view of the garment hanger of FIG. 1.
Figure 3:
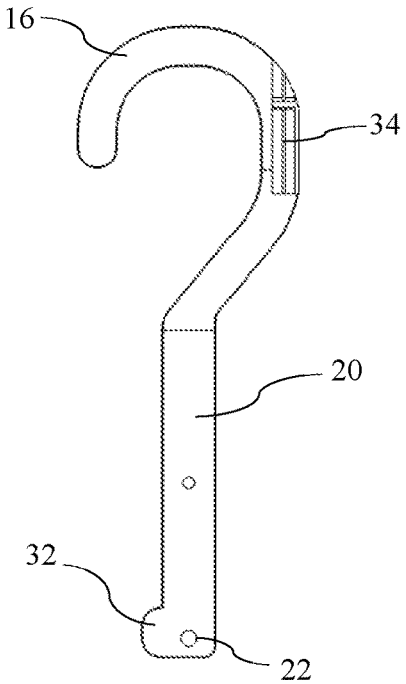
FIG. 3 shows a rear view of the garment hanger of FIG. 1.
Figure 4:
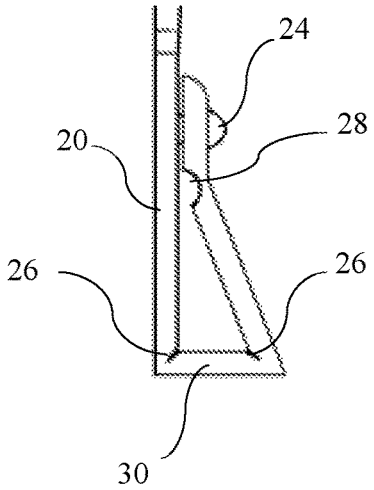
FIG. 4 shows the lower part of the garment hanger of FIG. 1 in a closed position.

FIGS. 1 to 8 show a garment hanger arrangement 10 comprising a garment hanger 12, an information element in the form of a sizer 14 that is slidably engageable with, or connectable to, the garment hanger 12.

The garment hanger 12 comprises a support-engaging portion in the form of a hook 16, a body section 18 and a deformable elongate member 20, the elongate member 20 comprising a first part of a connection mechanism 22 and the hanger having a second part of a connection mechanism 24 positioned away from the first part of the connection mechanism 22, such that the elongate member 20 can be deformed back upon itself and connected to the hanger 12 to form a loop. The end of the elongate member 20 distal from the support-engaging portion 16 is narrower than the span of the support engaging portion 16.

The first part of the connection mechanism 22 is in the form of an aperture arranged at the end of the elongate member 20 that is distal from the support-engaging hook 16. The second part of the connection mechanism 24 is in the form of a nipple arranged at the end of the elongate member 20 that is proximal to the support-engaging hook 16, or on the body section 18. The aperture 22 is sized to fit over the nipple 24 so that the parts releasably engage but can be readily released. It will be appreciated that the parts may be reversed so that the nipple and aperture are in reverse positions. Alternatively, other connection or fastening mechanisms may be employed, such as hook-and-eye, poppers or other arrangements that retain the hanger in a closed position.

In the embodiment shown in the Figures, although it may be optional, the elongate member 22 comprises two predetermined weakened regions 26 and may include a third predetermined weakened region 28. The predetermined weakened regions 26 and 28 allow the elongate member 20, when it is in its deformed state to form a triangular loop that may have a substantially flat spacer 30 at the intended lower end of the triangular loop so that an item rests upon the substantially flat spacer 30, when in use.

Extending laterally from the end of the elongate member 20 is a side flange 32, which is provided with embossed grips 33. The side flange 32 is sized to allow a user to provide a force against the distal end of the elongate member 20 to either open or close the connection mechanism. This assists with providing sufficient force for the first part of the connection mechanism, aperture 22 to engage the second part of the connection mechanism, nipple 24 or to release the same.

Figure 5:
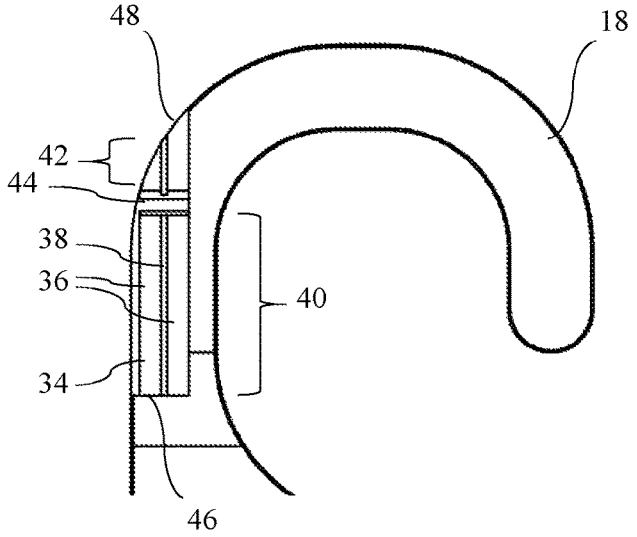
FIGS. 5 to 8 shows further detail on an information element channel of the garment hanger of FIG. 1 and an information element for reception therein.
Figure 6:
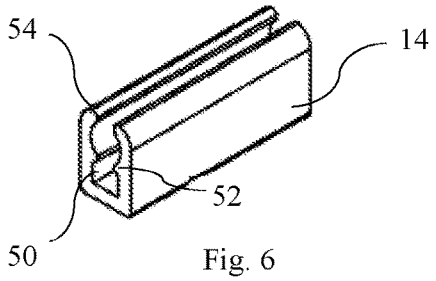
Figure 7:
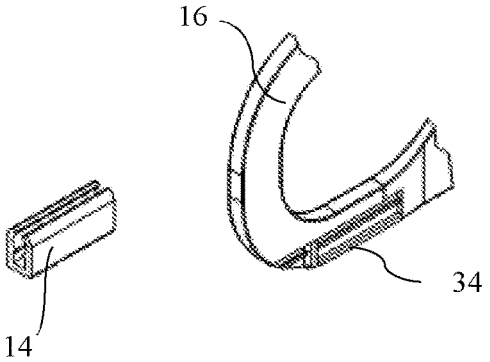
Figure 8:
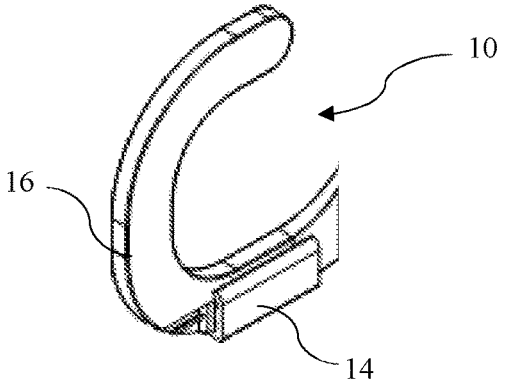

The hook 16 is provided with a channel 34, which is shown more clearly in FIG. 5. The channel 34 has a pair of parallel depressions 36 either side of a central ridge 38 and comprises a first section 40 and a second section 42, divided by a lateral ridge 44. The channel 34 is closed at one end 46 and open at the other end 48, so that a sizer element 14 can slidably engage the channel 34 through the open end 48 and abut the closed end 46. Whilst the channel 34 may be provided on just one side of the hanger, it is provided on both sides of the hanger 12 in the embodiment shown in the Figures.

The sizer 14 is cuboid shaped, although other shapes may be employed, and has a U-shaped recess 50 along on edge. The U-shaped recess 50 has a first pair of inwardly projecting protrusions 52 along its internal surface and a second pair of inwardly projecting protrusions 54 adjacent the open end of the U-shaped recess 50. The sizer 14 comprises a resiliently yieldable material to allow it to elastically deform.

To apply the sizer 14 to the hanger, the sizer 14 is slid into the channel 34 of the garment hanger 12 from a direction that is substantially parallel with the length of the recess 34 so that the U-shaped recess 50 of the sizer 14 is arranged adjacent the edge of the garment hanger 12 and substantially parallel with the length of the channel 34.

To remove the sizer 14 from the hanger 12, the reverse steps are undertaken and the sizer 14 is disengaged from the channel 34 of the garment hanger 12.

The use of a spacer section may be advantageous; however, the device elongate member may flex and so make a loop, without a spacer section present.

A "garment" is generally considered to be an item of clothing that may be worn by a person. Therefore, it may include, but is not limited to, trousers, shorts, jeans, skirts, jackets, jumpers or shirts. Accessories, such as hats, sunglasses, bags and belts are not considered to be garments.

Figure 9:
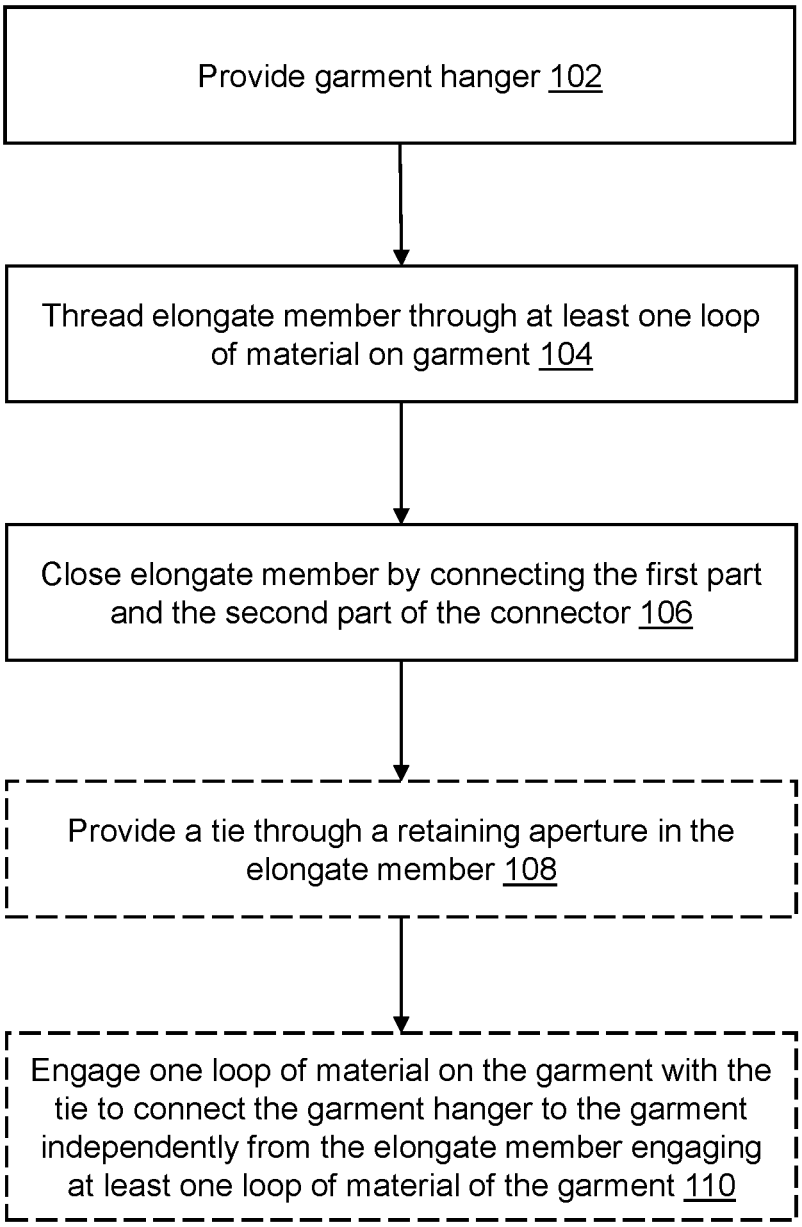

FIG. 9 depicts a method 100 of hanging a garment. In step 102, a garment hanger is provided. In step 104, the elongate member is threaded through at least one loop of material on a garment. In step 106, the elongate member is closed by connecting the first part and the second part of the connector. In optional step 108, a tie is provided through a retaining aperture in the elongate member. In optional step 110, the tie engages one loop of material on the garment to connect the garment hanger to the garment independently from the elongate member engaging at least one loop of material of the garment.

The invention claimed is:

1. A garment hanger comprising:

a rail engaging hook;

a deformable elongate member connected to the rail engaging hook and including a side flange and a garment engaging end both located distally from the rail engaging hook; and a connector comprising a first part and a second part, wherein the deformable elongate member is deformable back upon itself, such that when the first part is connected to the second part of the connector the deformable elongate member forms a closed loop;

wherein, when the connector forms the closed loop, the side flange is located adjacent to an opposite portion of the deformable elongate member;

wherein the side flange is attached to an adjacent portion of the deformable elongate member, such that, when the connector forms the closed loop, a width of the side flange overlaps and extends laterally outward beyond a width of the opposite portion of the deformable member to allow a user to provide a force against the deformable elongate member via the side flange to either open or close the connector.

2. A garment hanger according to claim 1, wherein the side flange is at or adjacent the end of the deformable elongate member distal from the rail engaging hook.

3. A garment hanger according to claim 1, wherein the connector comprises a click-fit fastening.

4. A garment hanger according to claim 1, wherein the side flange comprises a debossed or embossed section.

5. A garment hanger according to claim 1, wherein the first part or the second part of the connector comprises an aperture in the garment engaging end.

6. A garment hanger according to claim 1, wherein the side flange is less than half of the width of the deformable elongate member.

7. A garment hanger according to claim 6, wherein the side flange is less than a quarter of the width of the deformable elongate member.

8. A garment hanger according to claim 1, wherein the side flange extends in a direction non-parallel with the length of the deformable elongate member.

9. The garment hanger of claim 1, wherein the side flange is located at a distal end of the deformable elongate member.

10. The garment hanger of claim 1, wherein the side flange is positioned adjacent to the first part or the second part of the connector.

11. A method of hanging a garment comprising the steps of:

providing a garment hanger according to claim 1;

threading the deformable elongate member through at least one loop of material on a garment; and closing the deformable elongate member by connecting the first part and the second part of the connector.

12. A method according to claim 11, wherein the garment hanger is threaded through a plurality of loops of material on the garment.

13. A method according to claim 11, wherein a tie is provided through a retaining aperture in the deformable elongate member and the tie engages one loop of material on the garment to connect the garment hanger to the garment independently from the deformable elongate member engaging at least one loop of material of the garment.

* * * * *